US009687022B2

(12) United States Patent
Shan et al.

(10) Patent No.: US 9,687,022 B2
(45) **Date of Patent: *Jun. 27, 2017**

(54) PROVIDING HEAT FOR USE INSIDE A STRUCTURE

(71) Applicant: Emerson Electric Co., St. Louis, MO (US)

(72) Inventors: Ping Shan, Jiangsu (CN); Weihua Guo, Jiangsu (CN)

(73) Assignee: Emerson Electric Co., St. Louis, MO (US)

( * ) Notice: Subject to any disclaimer, the term of this patent is extended or adjusted under 35 U.S.C. 154(b) by 349 days.

This patent is subject to a terminal disclaimer.

(21) Appl. No.: 14/551,199

(22) Filed: Nov. 24, 2014

(65) Prior Publication Data

US 2015/0075026 A1 Mar. 19, 2015

Related U.S. Application Data

(63) Continuation of application No. 13/664,522, filed on Oct. 31, 2012, now Pat. No. 8,898,927.

(30) Foreign Application Priority Data

Feb. 20, 2012 (CN) ..... 2012 1 0131198

(51) Int. Cl.
*F26B 19/00* (2006.01)
*A24B 3/18* (2006.01)
(Continued)

(52) U.S. Cl.
CPC ..... *A24B 3/18* (2013.01); *F26B 23/00* (2013.01); *F26B 9/06* (2013.01); *F26B 2200/22* (2013.01)

(58) Field of Classification Search
CPC .... F26B 9/00; F26B 9/06; F26B 19/00; F26B 23/00; F26B 2200/22; F25B 21/00; F25B 21/02; F24J 5/00; F24J 2/04; A24B 3/18
(Continued)

(56) References Cited

U.S. PATENT DOCUMENTS 3,866,334 A 2/1975 Huang
3,882,612 A 5/1975 Try et al.
(Continued)

FOREIGN PATENT DOCUMENTS

CN 103256806 8/2013

OTHER PUBLICATIONS

Chinese Office Action dated Aug. 1, 2014, issued in Chinese Patent of Invention Application No. 201210131198.8. which the instant application claims priority to; 14 pgs.

*Primary Examiner* — Stephen M Gravini
(74) *Attorney, Agent, or Firm* — Harness, Dickey & Pierce, P.L.C.

(57) ABSTRACT

Exemplary embodiments or implementations are disclosed of systems for providing heat for use inside a structure and control apparatus and methods relating to material drying systems. In an exemplary embodiment, a control apparatus for controlling heat and/or humidity inside a structure selects one or more heat sources from a plurality of heterogeneous heat sources. The heat sources include a heat storage reservoir and a heat pump system between which heat is selectively transferrable via a fluid of the heat storage reservoir and a refrigerant of the heat pump system. The selecting is performed based on sensor input(s). The control apparatus controls the selected heat source(s) to provide heat inside the structure.

20 Claims, 7 Drawing Sheets

(51) Int. Cl.
*F26B 23/00* (2006.01)
*F26B 9/06* (2006.01)

(58) Field of Classification Search
USPC ..... 34/282, 549, 105; 62/126, 175, 203; 236/51; 219/490, 492
See application file for complete search history.

(56) References Cited

U.S. PATENT DOCUMENTS

| | | | |
|---|---|---|---|
| 3,905,123 | A | 9/1975 | Fowler et al. |
| 4,111,259 | A | 9/1978 | Lebduska |
| 4,205,456 | A | 6/1980 | Ayers et al. |
| 4,375,806 | A | 3/1983 | Nishman |
| 4,567,939 | A | 2/1986 | Dumbeck |
| 5,131,238 | A | 7/1992 | Meckler |
| 5,311,748 | A | 5/1994 | Bahel et al. |
| 6,401,468 | B1 | 6/2002 | Hoyle et al. |
| 6,742,284 | B2 | 6/2004 | Dinh |
| 7,325,333 | B2 | 2/2008 | Tadano et al. |
| 7,748,137 | B2 | 7/2010 | Wang |
| 8,353,114 | B2 | 1/2013 | Beers et al. |
| 8,418,378 | B2 | 4/2013 | Nawrot et al. |
| 2002/0088139 | A1 | 7/2002 | Dinh |
| 2003/0029185 | A1 | 2/2003 | Kopko |
| 2006/0010708 | A1 | 1/2006 | Carin et al. |
| 2011/0173838 | A1 | 7/2011 | Nawrot et al. |
| 2013/0042499 | A1 | 2/2013 | Jerg et al. |
| 2013/0212901 | A1 | 8/2013 | Shan et al. |
| 2014/0047726 | A1 | 2/2014 | Thompson |
| 2014/0137569 | A1 | 5/2014 | Parish et al. |

PROVIDING HEAT FOR USE INSIDE A STRUCTURE

CROSS-REFERENCE TO RELATED APPLICATIONS

This application is a continuation of U.S. patent application Ser. No. 13/664,522 filed on Oct. 31, 2012 which claims the benefit and priority of Chinese Patent of Invention Application No. 201210131198.8 filed Feb. 20, 2012. The entire disclosures of the above applications are incorporated herein by reference.

FIELD

The present disclosure relates to, but is not necessarily limited to, apparatus and methods for drying materials.

BACKGROUND

This section provides background information related to the present disclosure which is not necessarily prior art.

In the tobacco industry, one of the key processes of tobacco production is leaf curing. Among many types of curing barns are two main types. One type uses coal as a heat source while the other type uses a heat pump as a heat source. Coal-fueled tobacco curing can generate huge amounts of pollution, which is why heat pumps are regarded as an alternative heat source for tobacco leaf processing.

Although a heat pump used for a curing barn emits essentially zero pollution, the price of heating is a concern. For a typical load of 3500 kilograms of fresh tobacco leaves, the energy consumed to dry the leaves is around 750 kilowatt hours.

Another issue with heat pump curing is the typical control system for the heat pump. Because coal-fueled tobacco curing barns presently have the largest market share, the typical control system for heat pump curing has been developed based on the characteristics of the control systems for coal-fueled tobacco curing barns.

There are very few control systems dedicated for a heat pump curing barn, as most control systems for heat pump curing bars are modified from coal-fueled curing control systems. Heat pump curing controls generally are only modifications of existing coal curing controls. For example, a typical heat pump controller switches compressors on and off by means of a single line commonly used by a controller in a coal burning system to control the operation of a blower.

SUMMARY

This section provides a general summary of the disclosure, and is not a comprehensive disclosure of its full scope or all of its features.

Exemplary embodiments or implementations are disclosed of systems for providing heat for use inside a structure and control apparatus and methods relating to material drying systems. An exemplary embodiment is directed to a control apparatus for controlling heat and/or humidity inside a structure. In this exemplary embodiment, the control apparatus includes at least one control configured to select one or more heat sources from a plurality of heterogeneous heat sources. The heterogeneous heat sources include a heat storage reservoir and a heat pump system, where heat is selectively transferrable between the heat storage reservoir and heat pump system via a fluid of the heat storage reservoir and a refrigerant of the heat pump system. The selecting is performed based on sensor input(s). The control apparatus is configured to control the selected heat source(s) to provide heat inside the structure.

Another exemplary embodiment is directed to a control method performed by at least one control of a control apparatus for controlling heat and/or humidity inside a structure. In this exemplary embodiment, the control(s) select(s) one or more heat sources for providing heat inside the structure from a plurality of heterogeneous heat sources. The heterogeneous heat sources include a heat storage reservoir and a heat pump system, where heat is selectively transferrable between the heat storage reservoir and the heat pump system via a fluid of the heat storage reservoir and a refrigerant of the heat pump system. The selecting is performed based on a plurality of sensor inputs. The control apparatus controls the selected heat source(s) to provide heat inside the structure.

Another exemplary embodiment is directed to a system that includes a heat storage reservoir configured to provide a fluid carrying heat directly to a structure to the interior of which the system is configured to supply heat and/or humidity. A heat pump system is configured to provide a refrigerant carrying heat directly to the structure. A control apparatus selectively configures the heat storage reservoir and heat pump system for transfer of heat between the heat storage reservoir and the heat pump system via the fluid and the refrigerant, based on a temperature of the structure interior and/or a temperature of the heat storage reservoir.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

The present disclosure, in various exemplary implementations or embodiments, is directed to systems for drying materials, including but not limited to tobacco, etc. The drying system includes a control apparatus configured to select from various heterogeneous heat sources, one or more of which may be renewable, for example, to help improve (or preferably optimize) heat supplied to, e.g., a drying barn, and/or to increase (or preferably maximize) energy savings. Heat source selection may be made, e.g., based on temperature in a drying barn and temperature of fluid in a heat storage reservoir. The fluid in the heat storage reservoir may be heated by one or more auxiliary heat sources, e.g., by solar means, and/or by means of electricity derived, e.g., from wind energy and/or water energy, and/or by energy obtained from a utility. The control apparatus may selectively operate the drying system using, e.g., vapor compression, hot fluid from the heat storage reservoir, or a combination of both.

Figure 1:
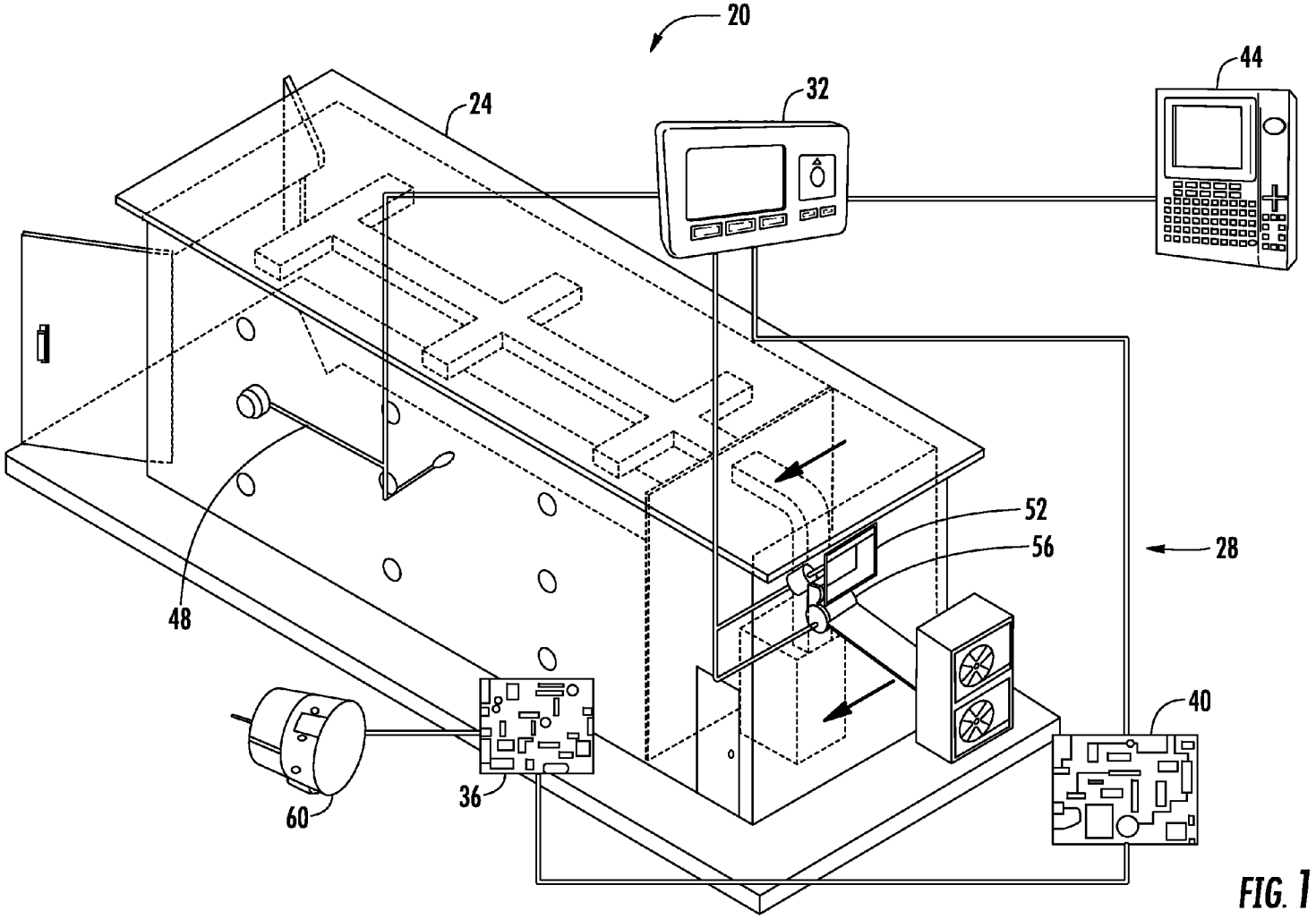
FIG. 1 is an illustration of a material drying system in accordance with an exemplary embodiment of the disclosure.

With reference now to the figures, FIG. 1 illustrates a material drying system 20 in accordance with an exemplary embodiment or implementation that embodies one or more aspects of the disclosure. As shown, the material drying system 20 includes a drying barn 24 in which, e.g., temperature and humidity are controlled by a control apparatus 28 to cure tobacco leaves. The control apparatus 28 includes a thermostat 32 configured to select one or more heat sources for the material drying system 20 from a plurality of heterogeneous heat sources (not shown in FIG. 1). The selecting or selection process is performed based on a plurality of sensor inputs. The control apparatus 28 is further configured to control operation of the selected heat source(s) to provide heat to the material drying system 20.

The thermostat 32 is configured to communicate with an indoor control 36, an outdoor control 40, and an optional remote management device 44. The thermostat 32 is also configured to communicate with a plurality of sensors 48 inside and/or outside the barn 24. The thermostat 32 may receive sensor inputs that include, e.g., signals indicating temperature, relative humidity, oxygen, carbon dioxide, etc. The thermostat 32 also provides output signals, e.g., direct signals to drive a damper 52 (e.g., via a damper drive signal) and to drive a humidifier 56 (e.g., via a humidifier drive signal).

The indoor control 36 may operate a blower 60 having an electronically controlled motor (ECM) inside the drying barn 24. The outdoor control 40 may operate a heat pump system (not shown in FIG. 1) that includes a compressor as further described below.

The thermostat 32 may also be configured for two-way communication, e.g., with a utility company or energy provider to obtain power for the drying system 20. By way of example only, the thermostat 32 may communicate with a smart meter via ZigBee® Alliance Smart Energy profile 1.1, which profile defines device descriptions and standard practices for Demand Response and Load Management "Smart Energy" applications needed in a Smart Energy based residential or light commercial environment. Continuing with this example, the key application domains included in this profile version are metering, pricing, and demand response and load control applications, though other applications may also be added or used. The hardware connection may be a Zigbee® wireless 2.4 Gigahertz (GHz) transceiver. In other exemplary embodiments, other solutions may be used to address the communication between the thermostat and a utility company/energy provider. For example, another exemplary embodiment may use a utility company's proprietary protocol and use RS-485 twisted wires for communications between a thermostat and the utility company.

The thermostat 32 may send and/or receive some operational signals, e.g., in accordance with a four-wire communication protocol made available through ClimateTalk® Alliance, 2400 Camino Ramon, Suite 375, San Ramon, Calif. 94583, USA, www.climatetalkalliance.org. For example, the thermostat 32, the indoor control 36, and the outdoor control 40 may communicate with one another using the ClimateTalk® protocol. The thermostat 32 is configured to communicate with the remote management device 44, e.g., in accordance with BACnet® protocol, supported and maintained by the American Society of Heating, Refrigerating and Air-Conditioning Engineers (ASHRAE).

The control apparatus 28 may be configured for wireless communication. For example, in some configurations, sensor input from one or more of the sensors 48 may be wirelessly transmitted, e.g., to the thermostat 32 via ZigBee® radiofrequency modules. Additionally or alternatively, at least some communications among the thermostat 32, indoor control 36, and outdoor control 40 may be wireless, though they may also be wired. High-power components (e.g., peripherals of indoor and outdoor boards, etc.) have wired connections in this exemplary embodiments, such as the heat pump system compressor operated by the outdoor control 40 and the blower 60 operated by the indoor control 36. In some configurations, the indoor control 36 may be integrated with the outdoor control 40, e.g., to simplify system wiring and to reduce cost.

Figure 2:
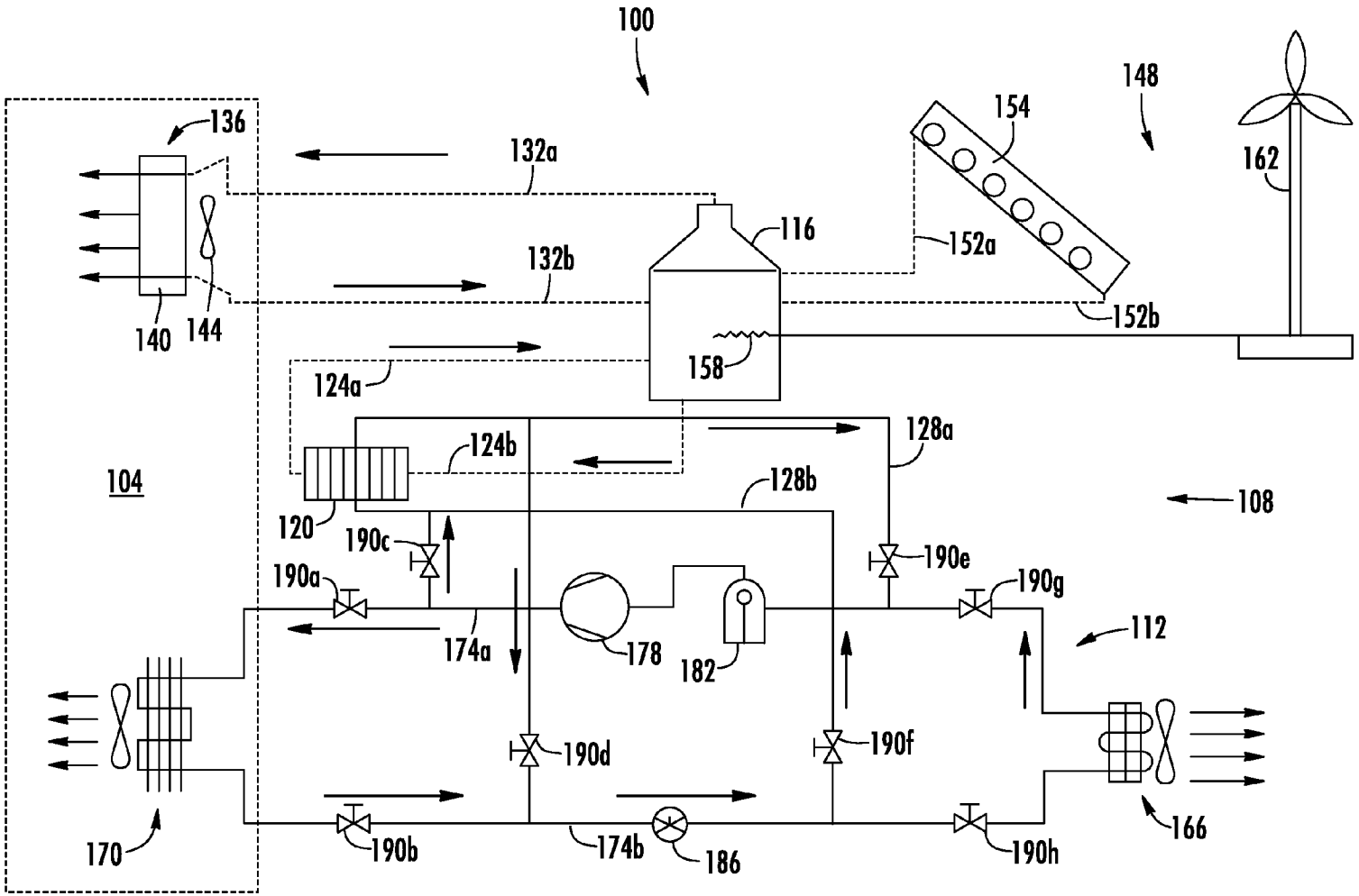
FIGS. 2-4 are diagrams of material drying systems in accordance with various exemplary embodiments of the disclosure.

FIG. 2 illustrates another example configuration of a material drying system 100 in which the control apparatus 28 may be included. As shown, the material drying system 100 includes a drying barn 104 and a plurality of heterogeneous heat sources indicated generally by reference number 108, configured to provide heat for drying material inside the barn. The thermostat 32 is configured to select one or more of the heterogeneous heat sources 108 based on sensor input and is also configured to control operation of the heat source(s) 108 to dry the material.

The heat sources 108 include a heat pump system 112 and a heat storage reservoir, e.g., a heat storage tank 116. A heat exchanger, e.g., a plate heat exchanger 120, is connected with the heat storage tank 116 via fluid lines **124*a* and 124*b*. The plate heat exchanger 120 is also connected with the heat pump system 112 via refrigerant lines 128*a* and 128*b*. For clarity of explanation, FIGS. 2, 3, and 4 indicates lines carrying fluid to and/or from the heat storage tank 116 are indicated by dashed lines, whiles lines for carrying refrigerant are indicated by solid lines. The storage tank 116 is connected via fluid lines 132*a* and 132*b* with a heat exchanger 136 in the barn 104. The heat exchanger 136 may include, e.g., an exchanger-like tube-fin evaporator 140 together with a fan 144**.

The heat storage tank 116 may be heated by one or more auxiliary heat sources 148. In the present example, the heat storage tank 116 may be heated by fluid circulating in fluid lines **152*a* and 152*b* between the heat storage tank 116 and one or more solar heat collectors 154. Additionally or alternatively, the heat storage tank 116 may be heated by a heating element 158 electrically heated by one or more wind power generators 162. Various materials (e.g., water, etc.) may be used inside the heat storage tank 116 to store heat. In place of, or in addition to, the tank 116, various reservoirs and/or heat-providing means and processes may be used. Heat may be stored, for example, through phase change processes and/or through the application of sensible heat and latent heat. The material drying system 100 is capable of using other or additional heat sources that may be non-polluting. Appropriate heat sources may vary dependent on where a given configuration of the drying system 100 may be used, e.g., geographically in which country, rural or urban area, etc. For example, wind power generators 162** may economically provide power in areas where wind is plentiful. Another auxiliary heat source can be a utility as further described below.

The heat pump system 112 includes an evaporator 166 capable of absorbing heat from the air, and a condenser 170 in the barn 104. The evaporator 166 is connected with the condenser 170 via refrigerant lines 174*a* and 174*b*. Refrigerant in the line 174*b* passes through a compressor 178 and an oil separator 182 to reach the condenser 170. Refrigerant in the line 174*b* passes through an expansion valve 186 to reach the evaporator 166. A plurality of valves 190*a* through 190*h* may be controlled by the thermostat 32 to direct the flow of refrigerant in the heat pump system 112 in accordance with various heating sequences as further described below. Valves 190*a* and 190*b* are operable to connect and/or disconnect the condenser 170 to and/or from the rest of the heat pump system 112. Valve 190*c* is operable to connect and/or disconnect the refrigerant line 128*b* to and/or from the refrigerant line 174*a* between the condenser 170 and the compressor 178. Valve 190*d* is operable to connect and/or disconnect the refrigerant line 128*a* to and/or from the refrigerant line 174*b* between the condenser 170 and the expansion valve 186. Valve 190*e* is operable to connect and/or disconnect the refrigerant line 128*a* to and/or from the refrigerant line 174*a* between the compressor 178 and the evaporator 166. Valve 190*f* is operable to connect and/or disconnect the refrigerant line 128*b* to and/or from the refrigerant line 174*b* between the expansion valve 186 and the evaporator 166. Valves 190*g* and 190*h* are operable to connect and/or disconnect the evaporator 166 to and/or from the heat pump system 112.

The thermostat 32 is capable of causing heat to be provided to the barn 104 preferentially from the heat storage tank 116 and less preferentially from the heat pump system 112, based, e.g., on temperature of fluid in the heat storage tank 116 and temperature in the drying barn 124. The thermostat 32 may operate the drying system 100 selectively using vapor compression, hot fluid from the heat storage tank 116, or a combination of both vapor compression and hot fluid. A combination of both may be used when a temperature of the tank fluid is higher than a temperature in the drying barn 104, but below that required for a drying cycle.

The thermostat 32 may communicate with one or more utilities to obtain power for heating the heat storage tank 116. A utility, for example, may supply power in an area in which demand for power fluctuates over a 24-hour cycle. Where, e.g., the demand is low such that the utility generates excess power, the thermostat 32 may cause the heat pump system 112 to start a heat storage cycle. Referring to FIG. 2, the thermostat 32 closes the valves 190*a* and 190*b* and opens the valves 190*c* and 190*d*. Instead of passing through the condenser 170, high-temperature refrigerant flows through the plate heat exchanger 120 to heat the fluid from the heat storage tank 116. The fluid inside the storage tank 116 thus can be used to directly provide heat to the drying barn 104 through the heat exchanger 136.

If the set temperature inside the barn 104 is higher than that of the heat storage tank 116, then in some implementations the thermostat 32 does not configure the drying system 100 to use direct heat transfer through the heat exchanger 136. Instead, the thermostat 32 starts the compressor 178 to draw heat from the heat storage tank 116. Accordingly, the valves 190*g* and 190*h* are closed, the valves 190*e* and 190*f* are opened, and heated refrigerant flows from the heat exchanger 120 through the compressor 178 to the condenser 170. Thus, both the fluid from the tank 116 and vapor compression are used to heat the refrigerant to a temperature appropriate for the drying process.

When the interior temperature of the heat storage tank 116 drops to a level at which not much heat can be drawn from the tank fluid, the valves 190*e* and 190*f* are closed and the valves 190*g* and 190*h* are opened. In this configuration, the heat pump system 112 may operate in the same or a similar manner as a typical heat pump and draws heat from outside air.

In order, e.g., to reduce curing costs, control logic in thermostat 32 may be configured to use the heat inside the heat storage tank 116 as much as possible. Accordingly, an example heating sequence may be as follows: first, to use heat from auxiliary heat sources 148; second, to use compressor-drawn heat from the heat storage tank 116; third, to use compressor-drawn heat from outside air.

Figure 3:
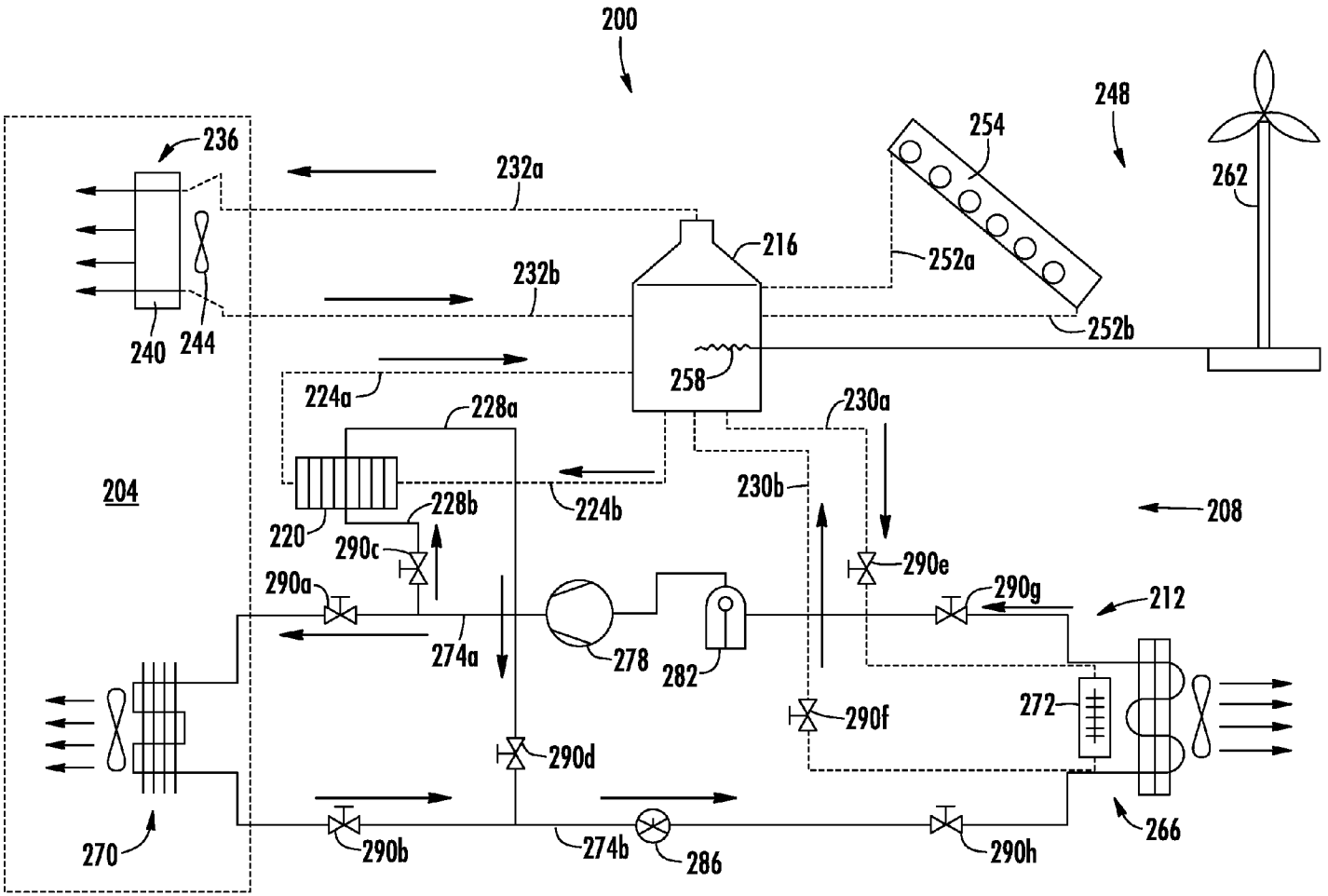

FIG. 3 illustrates another exemplary configuration of a material drying system 200 in which the control apparatus 28 may be included. The material drying system 200 may be similar to the above material drying system 100 though the illustrated material drying system 200 further includes a tube-fin type heat exchanger 272 is provided next to the evaporator 266 as explained below.

As shown in FIG. 3, the material drying system 200 includes a drying barn 204 and a plurality of heterogeneous heat sources, indicated generally by reference number 208, configured to provide heat for drying material inside the barn 204. The thermostat 32 is configured to select one or more of the heterogeneous heat sources 208 based on sensor input and is also configured to control operation of the heat source(s) 208 to dry the material.

The heat sources 208 include a heat pump system 212 and a heat storage reservoir, e.g., a heat storage tank 216. A heat exchanger, e.g., a plate heat exchanger 220, is connected with the heat storage tank 216 via fluid lines 224*a* and 224*b*. The plate heat exchanger 220 also is connected with the heat pump system 212 via refrigerant lines 228*a* and 228*b*. The storage tank 216 is connected via fluid lines 232*a* and 232*b* with a heat exchanger 236 in the barn 204. The heat exchanger 236 may include, e.g., an exchanger-like tube-fin evaporator 240 together with a fan 244.

The heat storage tank 216 may be heated by one or more auxiliary heat sources 248. In the present example, the heat storage tank 216 may be heated by fluid circulating in fluid lines 252*a* and 252*b* between the heat storage tank 216 and one or more solar heat collectors 254. Additionally or alternatively, the heat storage tank 216 may be heated by a heating element 258 electrically heated by one or more wind power generators 262. Various materials (e.g., water, etc.) may be used inside the heat storage tank 216 to store heat.

The heat pump system 200 includes an evaporator 266 capable of absorbing heat from the air, and a condenser 270 in the barn 204. A tube-fin type heat exchanger 272 is provided next to the evaporator 266. The heat exchanger 272 is connected with the heat storage tank 216 via fluid lines 230*a* and 230*b*. The evaporator 266 is connected with the condenser 270 via refrigerant lines 274*a* and 274*b*. Refrigerant in the line 274*a* passes through a compressor 278 and an oil separator 282 to reach the condenser 270. Refrigerant in the line 274*b* passes through an expansion valve 286 to reach the evaporator 266. A plurality of valves 290*a* through 290*h* may be controlled by the thermostat to direct the flow of refrigerant in the heat pump system 212. Valve 290*a* is operable to open and/or close the refrigerant line 274*a* between the condenser 270 and the compressor 278. Valve 290*b* is operable to open and/or close the refrigerant line

274*b* between the condenser 270 and the expansion valve 286. Valve 290*c* is operable to connect and/or disconnect the refrigerant line 228*b* to and/or from the refrigerant line 274*a* between the condenser 270 and the compressor 278. Valve 290*d* is operable to connect and/or disconnect the refrigerant line 228*a* to and/or from the refrigerant line 274*b* between the condenser 270 and the expansion valve 286. Valves 290*e* and 290*f* are operable to connect and/or disconnect the fluid lines 230*a* and 230*b* between the heat storage tank 216 and the heat exchanger 272. Valves 290*g* and 290*h* are operable to connect and/or disconnect the evaporator 266 from the heat pump system 212.

The system 200 may be controlled in various ways that are the same as or similar to ways in which the system 100 may be controlled. Additionally or alternatively, when the fluid temperature in the heat storage tank 216 is not high enough to provide sufficient heat to the drying barn 204, the compressor 278 may be started by the thermostat 32. Fluid from the heat storage tank 116 flows through the tube-fin exchanger 272 and gives heat to the evaporator 266. The system 200 thus can be capable of providing high overall heating efficiency.

Figure 4:
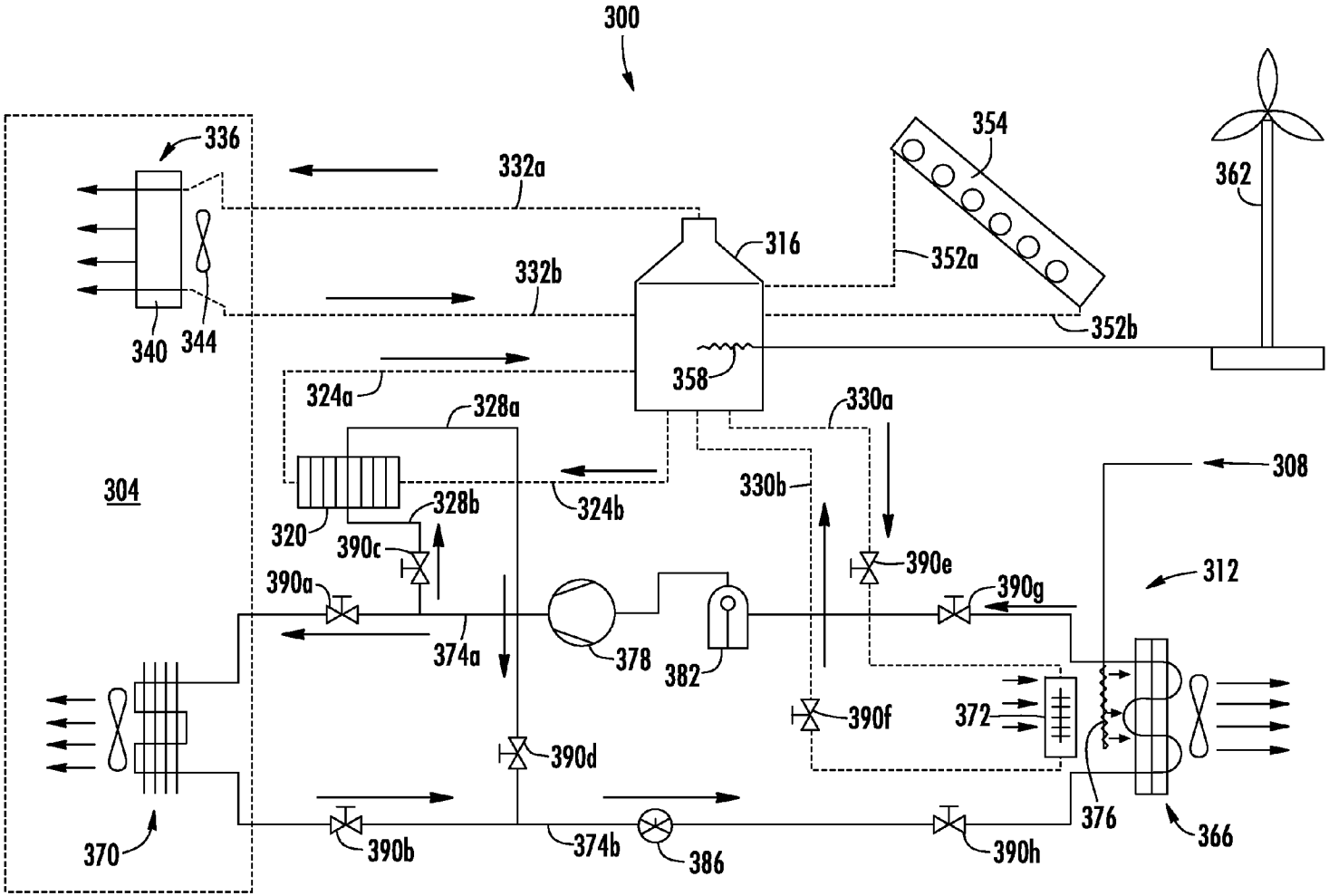

FIG. 4 illustrates another exemplary configuration of a material drying system 300 in which the control apparatus 28 may be included. The material drying system 300 may be similar to the above material drying system 200 though the illustrated material drying system 300 further includes an electric heating element 376 provided near the evaporator 366 as explained below.

As shown in FIG. 4, the material drying system 300 includes a drying barn 304 and a plurality of heterogeneous heat sources, indicated generally by reference number 308, configured to provide heat for drying material inside the barn 304. The thermostat 32 is configured to select one or more of the heterogeneous heat sources 308 based on sensor input and is also configured to control operation of the heat source(s) 308 to dry the material.

The heat sources 308 include a heat pump system 312 and a heat storage reservoir, e.g., a heat storage tank 316. A heat exchanger, e.g., a plate heat exchanger 320, is connected with the heat storage tank 316 via fluid lines 324*a* and 324*b*. The plate heat exchanger 320 also is connected with the heat pump system 312 via refrigerant lines 328*a* and 328*b*. The storage tank 316 is connected via fluid lines 332*a* and 332*b* with a heat exchanger 336 in the barn 304. The heat exchanger 336 may include, e.g., an exchanger-like tube-fin evaporator 340 together with a fan 344.

The heat storage tank 316 may be heated by one or more auxiliary heat sources 348. In the present example, the heat storage tank 316 may be heated by fluid circulating in fluid lines 352*a* and 352*b* between the heat storage tank 316 and one or more solar heat collectors 354. Additionally or alternatively, the heat storage tank 316 may be heated by a heating element 358 electrically heated by one or more wind power generators 362. Various materials (e.g., water, etc.) may be used inside the heat storage tank 316 to store heat.

The heat pump system 300 includes an evaporator 366 capable of absorbing heat from the air, and a condenser 370 in the barn 304. A tube-fin type heat exchanger 372 is provided next to the evaporator 366. The heat exchanger 372 is connected with the heat storage tank 316 via fluid lines 330*a* and 330*b*. An electric heating element 376 is provided near the evaporator 366. The heating element 376 can receive energy, e.g., from a utility and/or from self-generating sources, e.g., wind power sources and/or solar panels.

The evaporator 366 is connected with the condenser 370 via refrigerant lines 374*a* and 374*b*. Refrigerant in the line 374*a* passes through a compressor 378 and an oil separator 382 to reach the condenser 370. Refrigerant in the line 374*b* passes through an expansion valve 386 to reach the evaporator 366. A plurality of valves 390*a* through 390*h* may be controlled by the thermostat 32 to direct the flow of refrigerant in the heat pump system 312. Valve 390*a* is operable to open and/or close the refrigerant line 374*a* between the condenser 370 and the compressor 378. Valve 390*b* is operable to open and/or close the refrigerant line 374*b* between the condenser 370 and the expansion valve 386. Valve 390*c* is operable to connect and/or disconnect the refrigerant line 328*b* to and/or from the refrigerant line 374*a* between the condenser 370 and the compressor 378. Valve 390*d* is operable to connect and/or disconnect the refrigerant line 328*a* to and/or from the refrigerant line 374*b* between the condenser 370 and the expansion valve 386. Valves 390*e* and 390*f* are operable to connect and/or disconnect the fluid lines 330*a* and 330*b* between the heat storage tank 316 and the heat exchanger 372. Valves 390*g* and 390*h* are operable to connect and/or disconnect the evaporator 366 from the heat pump system 312.

The system 300 may be controlled in various ways that are the same as or similar to ways in which the systems 100 and/or 200 may be controlled. When the fluid temperature in the heat storage tank 316 is not high enough to provide sufficient heat to the drying barn 304, the compressor 378 may be started by the thermostat 32. Fluid from the heat storage tank 316 flows through the tube-fin exchanger 372 and gives heat to the evaporator 366. The electric heating element 376 can improve the operation and capacity of the compressor 378. Thus, a smaller compressor may be used with system 300 as compared to various other systems. The system 300 thus can be capable of providing high overall heating efficiency at reduced system cost.

Figure 5A:
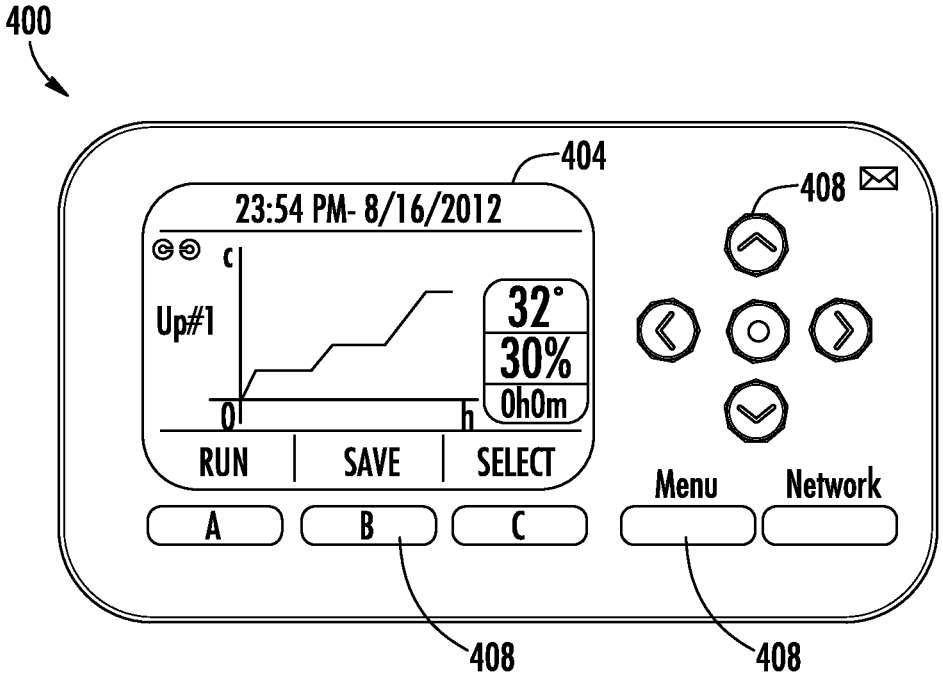
FIG. 5A illustrates an exemplary embodiment of a thermostat that may be used in a material drying system, where the thermostat is shown with a default screen shot in which a graph is displayed of a drying cycle for the material drying system.
Figure 5B:
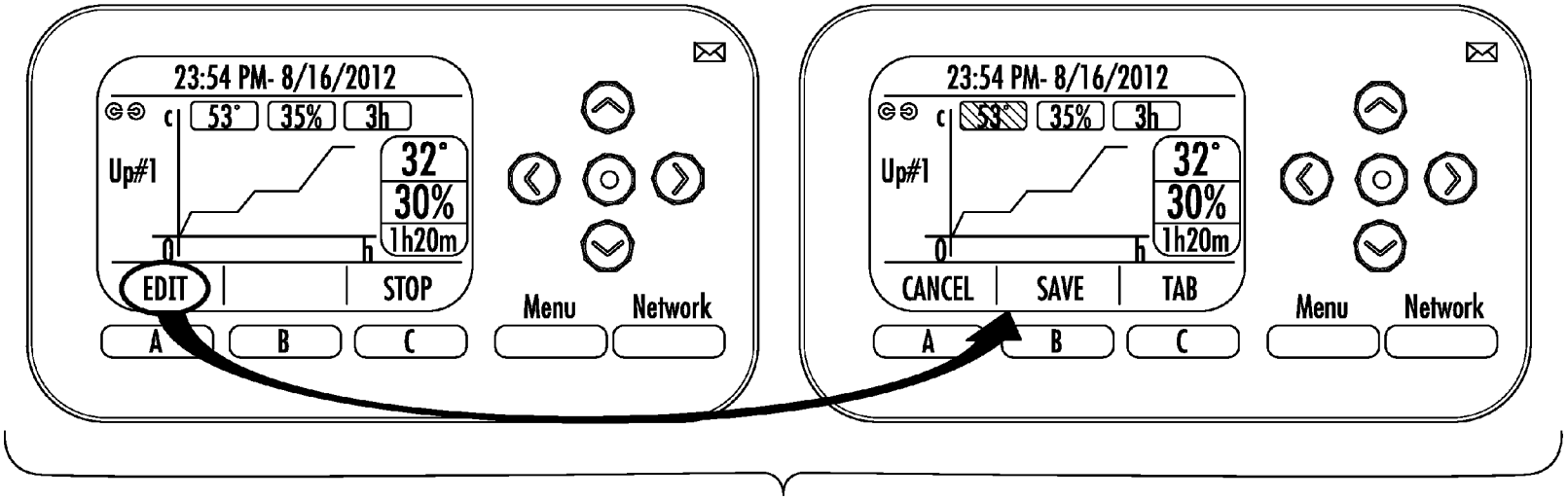
FIG. 5B illustrates the thermostat shown in FIG. 5A during an exemplary programming process by a user of the thermostat's user interface.
Figure 5C:
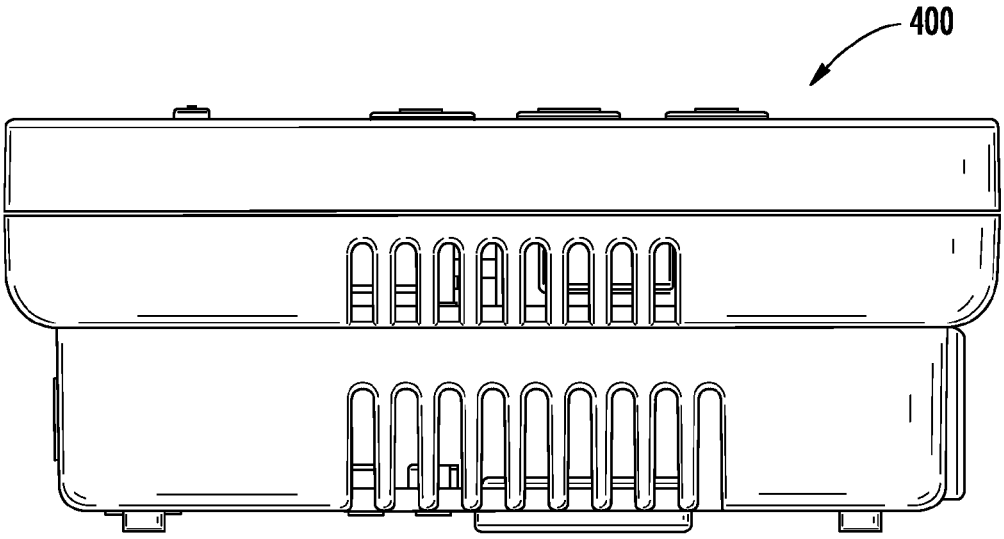
FIG. 5C is a side view of the thermostat shown in FIG. 5A.

FIGS. 5A, 5B, and 5C illustrate an exemplary embodiment of a thermostat 500 that may be used as a thermostat (e.g., thermostat 32, etc.) in an exemplary embodiment of a control apparatus (e.g., control apparatus 28 (FIG. 1), etc.) and/or material drying system (e.g., system 100 (FIG. 2), system 200 (FIG. 3), system (FIG. 300, etc.). As shown in FIGS. 5A and 5B, the thermostat 400 includes a user interface including a display 404 (e.g., a liquid crystal display (LCD), etc.) and buttons 408. By way of example, the display 404 may display a graph representing a drying cycle for the material drying system, the parameters of which may be modifiable or changed by a user. For example, the buttons 408 with the arrows may be operable to allow a user to navigate around the display 408 to highlight different features displayed on the display 404 with the middle or center button enabling selection of a highlighted feature. The buttons with the up and down arrows may be operable for incrementally increasing or decreasing a highlighted parameter for the drying cycle, such as temperature, humidity, duration, etc. The buttons labeled A, B, C, Menu, and Network may be used for programming the thermostat. As shown by a comparison of FIG. 5A with FIG. 5B, the function of buttons A, B, and C will change according to menu driven programming. In use, the buttons 408 may, for example, to allow the user to select, set, or change parameters of a drying cycle such as process temperature, humidity, duration, etc. for drying the material. Other exemplary embodiments may include a thermostat having a different menuing structure (e.g., buttons that allow a user to select a particular type of tobacco leaf or other material to be dried, etc.) and/or include a different configuration (e.g., different control buttons, different control button arrangement, different display, etc.) than what is shown in FIGS. 5A and 5B.

In an exemplary embodiment, a control, controller, or control apparatus for a drying system (e.g., a drying system for a tobacco curing barn, etc.) can choose from among a variety of heat sources (e.g., one or some renewable, etc.) to improve or preferably optimize the heat supplied to the drying barn, while also improving or preferably maximizing energy savings. In this example, the decision is preferably made as a function of ambient temperature, process temperature (e.g., set-point temperature or predetermined temperature set for drying tobacco leaves inside a tobacco leaf curing barn, etc.), and temperature of water in a tank. The water in the tank may, for example, be heated by solar means or electrically from electricity derived from wind energy. The control may choose to operate the heating system by vapor compression, hot water from the storage tank, or by a combination of both when the temperature of the water is above the ambient temperature, but below that required for the drying cycle. In this situation, the control runs the refrigerant through a heat exchanger taking hot water from the tank, then uses the vapor compression cycle to heat the refrigerant to the temperature required for the drying process.

In an exemplary embodiment, a heat based system is configured with the ability to use alternate energy sources as a function of ambient temperature, temperature of hot water in a storage tank, and process temperature. The process temperature may be a temperature set, selected, and/or predetermined for drying a particular type of tobacco leaf inside a curing barn, which type of leaf may be selected via a user interface, such as a display and buttons of a thermostat, etc.

Another exemplary embodiment includes a system, which comprise a standard air conditioning system set up to reject heat to the interior of the structure as opposed to the outside without requiring a heat pump. By way of further example, another exemplary embodiment is configured such that the entire heating operation is run off of a fan coil control, with all the heat coming from the hot water tank and thus without any vapor compression system involved. In this latter example, the control or controller is configured to be operable for choosing between conventional heating of the water, using electric elements powered by the grid, and/or alternative power supplied by solar or wind power.

The foregoing apparatus and methods may provide one or more advantages and improvements over existing material drying systems and methods. The use of auxiliary heat sources and heat storage technology can greatly reduce the costs of curing. When a curing season coincides with seasons in which utilities have excess capacity, using the excess capacity can be highly cost-effective. For example, tobacco curing season in China is around June to September. In some provinces, hydroelectric power is the main utility-supplied type of power. The curing season is also typically rich in rain and water. Hydroelectric power plants frequently have excessive capacity at such times but cannot sell the power to customers. When configurations of the foregoing material drying system and control apparatus are implemented, two-way communications between a utility company and a curing barn can result in benefits to both parties and is a smart use of energy in the tobacco curing industry. A utility company can sell more power, and a customer can increase its savings through the use of demand response and load control technology.

In various implementations of the disclosure, the material drying system operates as a typical heat pump only when more cost-effective auxiliary heat cannot be provided to keep up the temperature as needed for drying. In various implementations, software algorithm(s) and heat pump control can be provided by which tight temperature control (±1 F) and humidity control (±5%) may be achieved. In embodiments incorporating four-wire and wireless technology, installation and maintenance costs can be reduced. Diagnostics technology can be incorporated to improve system reliability. Data logging and the foregoing remote management capability can enable a user to optimize curing through the use of data analysis.

The foregoing apparatus and methods can meet the needs of curing barn operators to reduce utility costs. The foregoing apparatus and methods may also provide one or more improvements over existing control systems. As recognized by the inventor hereof, some existing control systems tend to have too many wires, control logic that is not optimized for heat pump operations, and very poor overall control precision. As also recognized by the inventor hereof, some currently available heat pump control systems allow large differentials in temperature and humidity to develop, which large differentials can greatly affect the quality of tobacco leaves. In contrast, the inventor hereof has disclosed exemplary embodiments of control systems and methods that may provide more precise control of temperature and humidity and/or that may allow reduce utility costs, etc.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (the disclosure of a first value and a second value for a given parameter can be interpreted as disclosing that any value between the first and second values could also be employed for the given parameter). Similarly, it is envisioned that disclosure of two or more ranges of values for a parameter (whether such ranges are nested, overlapping or distinct) subsume all possible combination of ranges for the value that might be claimed using endpoints of the disclosed ranges.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A control apparatus for controlling heat and/or humidity inside a structure, the control apparatus comprising:

at least one control configured to select one or more heat sources from a plurality of heterogeneous heat sources based on one or more sensor inputs, the heterogeneous heat sources including a heat storage reservoir and a heat pump system, where heat is selectively transferrable between the heat storage reservoir and the heat pump system via a fluid of the heat storage reservoir and a refrigerant of the heat pump system;

the control apparatus further configured to control the one or more selected heat sources to provide heat inside the structure.

2. The control apparatus of claim 1, wherein the at least one control comprises a thermostat, which is configured to select the one or more heat sources.

3. The control apparatus of claim 2, wherein the thermostat is configured to select the heat storage reservoir and/or the heat pump system for providing heat based on one or more of the following: ambient temperature, and a temperature of fluid within the heat storage reservoir.

4. The control apparatus of claim 3, wherein the thermostat is configured to select the heat storage reservoir as a primary heat source and the heat pump system as a secondary heat source, which selection is based on a temperature of the heat storage reservoir.

5. The control apparatus of claim 1, wherein the at least one control is configured to be in communication with one or more auxiliary providers of heat to the heat storage reservoir.

6. The control apparatus of claim 5, configured in a system wherein the one or more auxiliary providers of heat to the heat storage reservoir include one or more of a solar power source, a wind power source, a hydroelectric power source, and a utility.

7. The control apparatus of claim 1, wherein the at least one control is configured to cause fluid to flow from the heat storage reservoir to a heat exchanger to heat a refrigerant of the heat pump system, and to cause compression of the heated refrigerant to provide heat to the structure.

8. The control apparatus of claim 1, wherein the at least one control is configured to:

primarily, provide heat from one or more auxiliary providers of heat to the heat storage reservoir;

secondarily, use compressor-drawn heat from the heat storage reservoir to provide heat inside the structure; and tertiarily, use compressor-drawn heat from outside air to provide heat inside the structure.

9. The control apparatus of claim 1, configured in a system wherein:

the plurality of heterogeneous heat sources includes one or more renewable heat sources; and/or the one or more sensor inputs include one or more of the following: ambient temperature, and temperature of fluid within the heat storage reservoir.

10. A control method comprising:

selecting one or more heat sources for providing heat inside a structure from a plurality of heterogeneous heat sources based on one or more sensor inputs, the heterogeneous heat sources including a heat storage reservoir and a heat pump system, where heat is selectively transferrable between the heat storage reservoir and the heat pump system via a fluid of the heat storage reservoir and a refrigerant of the heat pump system, the selecting performed by at least one control of a control apparatus for controlling heat and/or humidity inside the structure; and the at least one control controlling the one or more selected heat sources to provide heat inside the structure.

11. The method of claim 10, wherein the one or more sensor inputs include one or more of the following: a temperature of fluid within the heat storage reservoir, and ambient temperature.

12. The method of claim 11, further comprising the at least one control communicating with one or more auxiliary providers of heat to the heat storage reservoir.

13. The method of claim 12, wherein the one or more auxiliary providers of heat to the heat storage reservoir include one or more of a solar power source, a wind power source, a hydroelectric power source, and a utility.

14. The method of claim 10, the method further comprising:

the at least one control causing fluid to flow from the heat storage reservoir to heat the refrigerant of the heat pump system; and the at least one control causing compression of the heated refrigerant to provide heat inside the structure.

15. The method of claim 10, wherein:

the at least one control includes a thermostat, and the selecting is performed by the thermostat; and/or the plurality of heterogeneous heat sources includes one or more renewable heat sources.

16. The method of claim 10, further comprising the at least one control performing the following to supply heat inside the structure:

primarily providing heat from one or more auxiliary providers of heat to the heat storage reservoir;

secondarily using compressor-drawn heat from the heat storage reservoir; and tertiarily using compressor-drawn heat from outside air.

17. The method of claim 10, further comprising the at least one control:

supplying heat from vapor compression to the interior of the structure;

supplying heat from hot water within a storage tank to the interior of the structure; and/or using both the heat from vapor compression and the heat from hot water within the storage tank when the temperature of the water is above ambient but below a designated temperature.

18. A system comprising:

a heat storage reservoir configured to provide a fluid carrying heat directly to a structure to the interior of which the system is configured to supply heat and/or humidity;

a heat pump system configured to provide a refrigerant carrying heat directly to the structure; and a control apparatus for selectively configuring the heat storage reservoir and heat pump system for transfer of heat between the heat storage reservoir and the heat pump system via the fluid and the refrigerant, based on a temperature of the structure interior and/or a temperature of the heat storage reservoir.

19. The system of claim 18, further comprising:

a heat exchanger through which the heat is transferred between the heat storage reservoir and the heat pump system; and a plurality of heterogeneous auxiliary heat sources for providing heat to the heat storage reservoir.

20. The system of claim 19, wherein:

the control apparatus comprises a thermostat configured to select one or more of the auxiliary heat sources to provide heat to the heat storage reservoir; and/or the heterogeneous auxiliary heat sources comprise one or more of a solar collector, a wind power generator, hydroelectric power, and a utility.

* * * * *